United States Patent [19]

Cavin

[11] Patent Number: 4,587,388

[45] Date of Patent: May 6, 1986

[54] REMOTE SWITCHING DEVICE FOR ELECTRIC TROLLING MOTOR

[76] Inventor: Eugene F. Cavin, 1000 4th St., Harvard, Ill. 60033

[21] Appl. No.: 642,414

[22] Filed: Aug. 20, 1984

[51] Int. Cl.[4] ..... H01H 21/26

[52] U.S. Cl. ..... 200/86.5; 74/512; 114/144 A; 200/153 C; 440/7

[58] Field of Search ..... 114/144 A, 153; 74/512; 440/7, 53, 63; 200/86.5, 51 R, 153 C

[56] References Cited

U.S. PATENT DOCUMENTS

| | | | |
|---|---|---|---|
| 2,111,311 | 3/1938 | Child | 200/153 C |
| 2,804,838 | 9/1957 | Moser . | |
| 3,511,208 | 5/1970 | Woodruff . | |
| 3,598,947 | 8/1971 | Osborn . | |
| 3,602,181 | 8/1971 | Harris | 114/153 |
| 4,143,436 | 3/1979 | Jones . | |
| 4,172,217 | 10/1979 | Miller | 200/86.5 |
| 4,322,711 | 3/1982 | Spangler | 74/512 |
| 4,386,918 | 6/1983 | Matthews . | |

*Primary Examiner*—G. P. Tolin

*Attorney, Agent, or Firm*—Mathew R. P. Perrone, Jr.

[57] ABSTRACT

A switch device for operating an electric boat motor for use in trolling for fish includes a durable rustproof housing having secured therein a foot operated switch which is activated when pressed and deactivated when released. The switch is connected at one end of a substantial length of conductor. At the other end of the conductor are motor clips for securing the switch in an operable fashion to an electric trolling motor.

13 Claims, 4 Drawing Figures

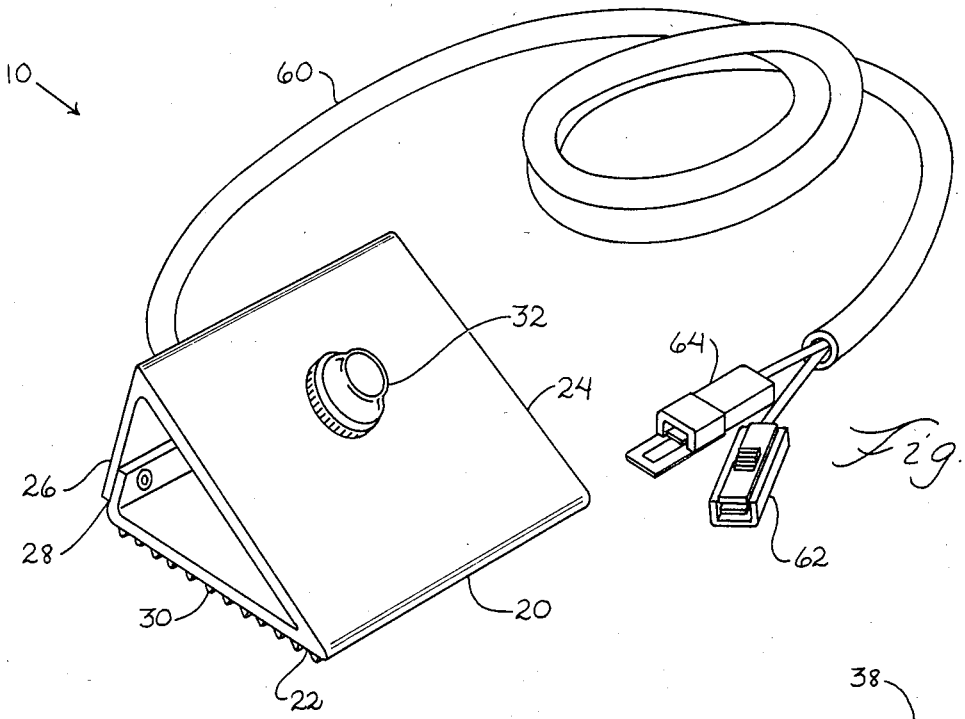
Fig. I
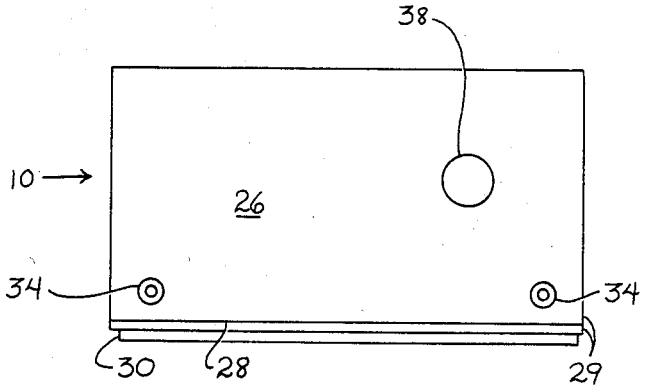
Fig. II
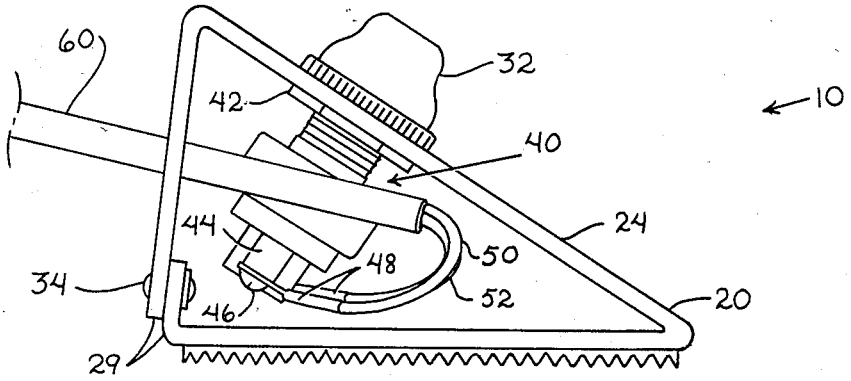
Fig. III

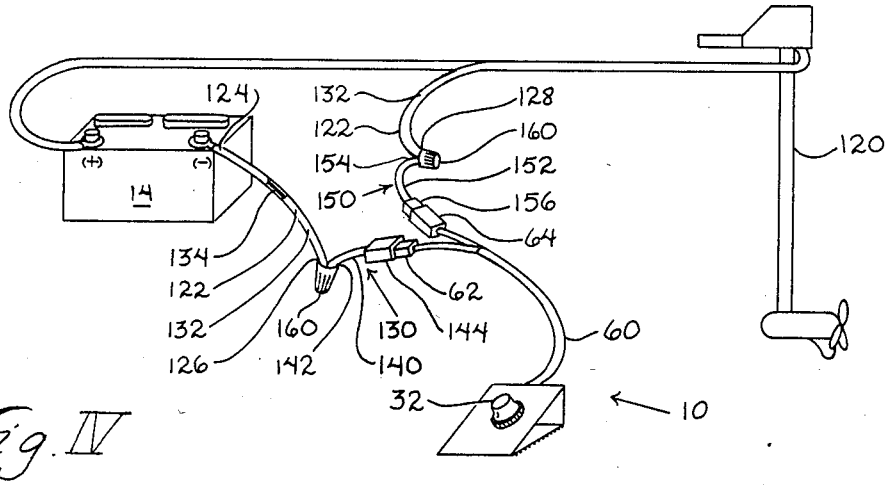
Fig. IV

REMOTE SWITCHING DEVICE FOR ELECTRIC TROLLING MOTOR

BACKGROUND OF THE INVENTION

This invention relates to a remote switching device and more particularly to a remote switching device for use with electric trolling motors.

Electric trolling motors are commonly used by fishermen, who desire to move at a slow speed silently or pause, and play out the line to permit the hook to be dragged through the water and catch the attention of fish. In this fashion the fishing can be done more efficiently.

With these electric motors, it is sometimes desired to provide a foot operated switch for running the electric motor. With this foot operated switch, the fisherman can be free to use both hands on the fishing rod. Some electric motors have these switching devices built into the motor. However, due to their size and the nature of the permanent attachment, the built in switches are restrictive and do not provide for the flexibility required for the motor. When the switches are built in, the flexibility and differing positions of the fisherman are not generally permitted.

There is no one good switching device on the market or readily available, which a person can quickly attach to or remove from an electric trolling motor. Those switching devices that are on the market for the purpose of attaching to the motor have neither the desired flexibility nor the desired simplicity of attachment. Where it is on the motor—because of their size and configuration—the switching device is not generally adaptable for use on the smaller boat.

The switches also have too many additional features which are not required or desired by the fisherman. Typical features—such as speed and direction control—add to cost and limit use of the switch to motors for larger boats only.

Additionally, none of the switches on the market provide safety in the case of a man overboard. It highly desirable to stop the boat and motor in the event of the fisherman falling overboard. If the boat stops, it is easier for the fisherman to overtake and reenter the boat. If the motor stops, chances of injury to fisherman in case of contact with the motor are greatly reduced. Thus, safety is increased if the motor and, hence, the boat can be quickly stopped.

Thus, it is highly desirable to provide a switching unit which is easily attached to or removed from a variety of trolling motors, which is movable about the boat for permitting the fisherman to assume different positions and which activates with foot pressure and deactivates upon release of the foot pressure. In this fashion, the fisherman can achieve greater control of the motor.

SUMMARY OF THE INVENTION

Therefore, it is an object of this invention to provide a switching device which is easily attached to an electric trolling motor.

A further object of this invention is to provide a device for use with an electric trolling motor which permits the fisherman to move about the boat to differing positions.

A still further object of this invention is to provide a device which permits foot operation of an electric trolling motor.

Yet a further object of this invention is to provide for a switch that is easily detached from the electric trolling motor.

Also an object of this invention is to provide for a switching device for use with an electric trolling motor that is operable when pressed by the foot and inoperable when released.

Another object of this invention is to provide a switching device for use with an electric trolling motor.

Yet another object of this invention is to provide a switching device which permits a fisherman to move to different positions within the boat and still maintain control of the boat.

Still another object of this invention is to provide a switching device which can stop the motor on release of the switch.

A further object of this invention is to provide a switching device for use with an electric trolling motor which improves safety of the user.

Still another object of this invention is to provide a switching device which can stop the boat on release of the switch.

These and other objects of the invention are met by having a switch mounted in a housing and removably securable to an electric trolling motor by an extended connecting package.

BRIEF DESCRIPTION OF THE DRAWING

FIG. I is a perspective view of the switch mechanism 10 of this invention.

FIG. II is a plan view of the rear side 26 of switch mechanism 10 of this invention.

FIG. III is a side view of switch mechanism 10 of this invention.

FIG. IV depicts switch mechanism 10 of this invention in circuit with an electric trolling motor 120 and battery 14.

Throughout the figures of the drawing where the same part appears in more than one figure, the same number is applied thereto.

DESCRIPTION OF THE PREFERRED EMBODIMENTS

A switch device for operating an electric boat motor for use in trolling for fish includes a durable rustproof housing having secured therein a foot operated switch which is activated when pressed and deactivated when released. The switch is connected at one end of a substantial length of conductor. At the other end of the conductor are motor clips for securing the switch in an operable fashion to an electric trolling motor.

Referring now to FIG. I, housing 20 of switch mechanism 10 is shown in a perspective view. Housing 20 has at the bottom thereof a base side 22. The cross section of housing 20 is basically triangular in shape. Thus, adjacent base side is a switch side 24. Connecting switch side and base side at one end thereof is a rear side 26. Within rear side 26, is a seam 28 formed by an overlap of the material used to make the housing 20.

Secured to the base 22 on the outside of housing 20 is base pad 30. Base pad 30 is generally textured to prevent the switch mechanism 10 from sliding over the bottom of the boat (not shown). In this fashion, the switch mechanism 10 can be placed and secured by the fisherman.

Secured in switch side 24 is switch button 32. Pressure on switch button 32 can turn on electric trolling motor 120. Release of pressure turns the motor 120 off, and the boat stops.

Referring now to FIG. II, rear side 26 is shown more clearly therein. Within rear side 26, rear rivet assembly 34 secures housing 20 in its generally triangular figuration. Thus, rear seam 28 has overlapping pieces 29, which are secured together by rivet assembly 34. Within rear side 26 is connector aperture 38. Conductor 60 passes therethrough after being connected to the switch assembly 40.

Referring now to FIG. III, which is a side view of the switch mechanism 10, the structure of switch assembly 40 can be more clearly seen. A standard screw and nut switch mount 42 is shown for securing the switch assembly 40 in the housing 20. Switch assembly 40 is a standard off/on switch, which is activated with pressure and deactivated by releasing the pressure. Switch assembly 40 includes switch button 32. Opposite switch button 32, which appears on the top of switch side 24, is switch connector 44 with screws 46 therein for the purpose of holding wire terminal clip 48 of first wire 50 and second wire 52 thereto. The terminal clip 48 on each of first wire 50 and second wire 52 may be the same or different and are defined as the same here.

Conductor 60 includes first wire 50 and second wire 52. Conductor 60 has the wire terminal clip 48 at one end, and male connector 62 and female connector 64 at the other end thereof. Male connector 62 is electrically connected to first wire 50, while female connector 64 is electrically connected to second wire 52. Male connector 62 and female connector 64 clearly connect the switch to the trolling motor 120 (shown in FIG. IV). The position of male connector 62 is interchangeable with female connector 64. Conductor 60 is of sufficient length to permit switch mechanism 10 to be placed in any position in the boat.

Base pad 30 keeps the switch mechanism 10 from moving about. In operation, the motor 120 is turned on. The switch button 32 is pressed and the boat moves as desired by the fisherman. If a strike is made or stopping the boat is necessary, the fisherman may release switch button 32 in order to stop the motor 120, thereby stopping boat automatically, while he handles the fish.

Installation of the switch mechanism 10 on trolling motor 120 is shown in FIG. IV to be simple. First it is necessary to locate black—negative wire 122 on motor 120. Negative wire 122 runs from motor 120 to battery 14. Then negative wire 122 is cut about seven to fifteen centimeters from battery clip 124 to form a first cut end 126 and a second cut end 128. Then a first short wire and plug connector 130 is installed in a standard fashion on first cut end 126 by removing about two centimeters of insulation 132 from first cut end 126 without cutting the metal core 134 of negative wire 122.

First short wire and plug connector 130 includes a connector wire 140 having a bare end 142 at one end thereof and a first female plug 144 electrically secured thereto and oppositely disposed from bare end 142. First female plug 144 is electrically cooperative with male connector 62.

In a like manner, a second short wire and plug connector 150 is installed in a standard fashion on second cut end 128 by removing about two centimeters of insulation 132 from second cut end 128 with out cutting the metal core 134 of negative wire 122.

Second short wire and plug connector 150 is similar to first short wire and plug connector 130. Second short wire and plug connector 150 includes a second connector wire 152 having a bare end 154 at one end thereof and a second male plug 156 electrically secured thereto and oppositely disposed from bare end 154. Second male plug 156 is electrically cooperative with female connector 64.

It becomes clear that second male plug 156 cooperates with either female connector 64 or first female plug 144. Thus male connector 62 cooperates with either female connector 64 or first female plug 144. Second Male plug 156 in conjunction first female plug 144 permits the motor 120 to operate without switch device 10, or with switch device 10 inserted in the circuit.

Wires desired to be connected together in an electrically conductive fashion are stripped of insulation and firmly twisted together in a clockwise direction. Then a plastic wire nut 160 (or other suitable insulation) are placed over the twisted wire ends and tightened also in a clockwise direction so that no bare wire is exposed to prevent possible shorting. As above stated, male connector 62 and female connector 64 are mutually cooperative with each other, as are first female plug 144 and second male plug 156. Such cooperation permits the simplified transfer of switch mechanism 10 from one trolling motor 120 to another. In any change of switch mechanism 10 to or from a motor 120—such as motor 120—it is safest to have the motor 120 turned off.

In use, switch mechanism 10 is placed in a convenient location in a boat. Then, the power switch for trolling motor 120 is activated and set at desired speed. Button 32 is then simply operated with the application of a foot to move boat, and stopped by releasing foot pressure. Thus, much more time to enjoy fishing without the annoying interruptions of controlling the motor 120 by hand.

All components of switch mechanism 10 must be waterproof, except push button switch 32, which is moisture proof and protected from excess water. Materials used to make switch mechanism 10 of this invention are customarily available in the marketplace. Housing 20 may be made of any suitable rust proof material. Housing 20 may be made of high impact polyethylene; or stress-relieved, high-density polyethylene—which are available from General Tire and Rubber Company. Conductor 60 may be any two-wire, flexible, conductor capable of carrying current and being waterproof. Other materials used are also conventional.

Because of this disclosure and solely because of this disclosure other modifications to this device will become clear to those having ordinary skill in the art. Such modifications are clearly covered hereby.

What is claimed and sought to be secured by letters patent of the United States is:

1. A switch mechanism for operating an electric trolling motor for use on a boat in trolling for fish, wherein said switch mechanism includes:

a. a housing for said switch mechanism, said housing being made of a rustproof material;

b. a foot-operated switch assembly secured within said housing and including a switch connector, said foot-operated switch assembly being activated when pressed and deactivated when released;

c. a substantial length of conductor being connected at a first conductor end thereof to said foot-operated switch in electrical cooperation therewith;

d. a second conductor end of said conductor being oppositely disposed from said first conductor end thereof;

e. a securing means for removably securing said second conductor end in electrical cooperation with said electric trolling motor;

f. said conductor including a first wire and a second wire within said conductor;

g. a wire clip electrically secured on each of a first end of said first wire and a first end of said second wire, said wire clip serving to electrically connect said first wire and said second wire to said switch connector;

h. said first end of said first wire and said first end of said second wire forming said first conductor end;

i. said second end of said first wire and said second end of said second wire forming said second conductor end;

j. said securing means including a switch male connector and a switch female connector;

k. said switch male connector being electrically connected to said first wire at a second end of said first wire; said second end of said first wire being oppositely disposed from said first end of said first wire; and l. said switch female connector being electrically connected to said second wire at a second end of said second wire; said second end of said second wire being oppositely disposed from said second end of said second wire.

2. The switch mechanism of claim 1 wherein said housing includes:

a. a base side capable of resting adjacent to the bottom of a boat;

b. a switch side adjacent said base side and at an acute angle with said base side; and c. a rear side connecting said switch side and said base side.

3. The switch mechanism of claim 2 wherein said housing further includes:

a. a base pad secured to said base side capable of resting on said bottom of said boat in order to prevent the sliding of said switch mechanism over said bottom of said boat; and b. a pressure-activated, switch button secured in said switch side; and c. a conductor aperture within said rear side permitting said conductor to pass from said switch button through said conductor aperture to said electric trolling motor.

4. A switch mechanism of claim 3 wherein said rear side further includes:

a. a rear seam formed by an overlap of material used to make said housing; and b. a rear rivet assembly securing said seam.

5. The switch mechanism of claim 4 wherein said switch assembly includes:

a. a standard screw and nut switch mount for securing said switch assembly in said housing;

b. a pressure-activated switch button within said switch assembly, said switch button being on a top of said switch side; and c. a switch connector oppositely disposed from said switch button and within said housing for electrically connecting said switch assembly to said conductor.

6. The switch mechanism of claim 5 wherein said switch male connector and said switch female connector are capable of being interchanged and interconnectable.

7. The switch mechanism of claim 6 wherein said conductor is of sufficient length to permit said switch mechanism to be placed in any position in said boat.

8. A separable combination of a foot-operated switch mechanism and an electric trolling motor, wherein said switch mechanism is removably secured to said motor to permit moving of said switch mechanism from one motor to another and is capable of turning said motor on when activated and off when deactivated, wherein said switch mechanism includes:

a. a housing for said switch mechanism, said housing being made of a rustproof material;

b. a foot-operated switch assembly secured within said housing and including a switch connector, said foot-operated switch assembly being activated when pressed and deactivated when released;

c. a substantial length of conductor being connected at a first conductor end thereof to said foot-operated switch in electrical cooperation therewith;

d. a second conductor end of said conductor being oppositely disposed from said first conductor end thereof;

e. a securing means for removably securing said second conductor end in electrical cooperation with said electric trolling motor;

f. a separated negative wire on said motor having a first cut end and a second cut end;

g. a first short wire and plug connector being electrically connected to said first cut end;

h. a second short wire and plug connector being electrically connected to said second cut end; and i. said first short wire and plug connector including a first connector wire, said first connector wire having a first bare end at one end thereof and a first female plug electrically secured thereto and oppositely disposed from bare end;

j. said second short wire and plug connector including a second connector wire, said second connector wire having a second bare end at one end thereof and a second male plug electrically secured thereto and oppositely disposed from said bare end;

k. said conductor including a first wire and a second wire within said conductor;

l. a wire clip electrically secured on each of a first end of said first wire and a first end of said second wire, said wire clip serving to electrically connect said first wire and said second wire to said switch connector;

m. said first end of said first wire and said first end of said second wire forming said first conductor end;

n. said second end of said first wire and said second end of said second wire forming said second conductor end;

o. a switch male connector being electrically connected to said second of said first wire at a second end of said first wire;

p. a switch female connector being electrically connected to said second end of said second wire;

q. said switch female connector being electrically cooperative with said second male plug; and r. a switch male connector being electrically cooperative with said first female plug.

9. The separable combination of a foot-operated switch mechanism and an electric trolling motor of claim 8 wherein said motor includes:

a. a base side capable of resting adjacent to the bottom of a boat;

b. a switch side adjacent said base side and at an acute angle with said base side; and c. a rear side connecting said switch side and said base side.

10. The separable combination of a foot-operated switch mechanism and an electric trolling motor of claim 9 wherein said housing further includes:

a. a base pad secured to said base side capable of resting on said bottom of said boat in order to prevent the sliding of said switch mechanism over said bottom of said boat; and b. a pressure-activated, switch button secured in said switch side; and c. a conductor aperture within said rear side permitting said conductor to pass from said switch button through said conductor aperture to said electric trolling motor.

11. The separable combination of a foot-operated switch mechanism and an electric trolling motor of claim 10 wherein said rear side further includes:

a. a rear seam formed by an overlap of material used to make said housing; and b. a rear rivet assembly securing said seam.

12. The separable combination of a foot-operated switch mechanism and an electric trolling motor of claim 10 wherein said switch assembly includes:

a. a screw and nut switch mount for securing said switch assembly in said housing;

b. a pressure-activated switch button within said switch assembly, said switch being on a top of said switch side; and c. a switch connector oppositely disposed from said switch button and within said housing for electrically connecting said switch assembly to said conductor.

13. The separable combination of a foot-operated switch mechanism and an electric trolling motor of claim 12 wherein said switch male connector and said switch female connector are capable of being interchanged and interconnectable.

* * * * *